United States Patent [19]

Nakajima

[11] Patent Number: 5,063,409

[45] Date of Patent: Nov. 5, 1991

[54] IMAGE RECORDING APPARATUS AND EXCHANGING UNIT USED IN THE SAME

[75] Inventor: Tomohiro Nakajima, Machida, Japan

[73] Assignee: Ricoh Company, Ltd., Tokyo, Japan

[21] Appl. No.: 610,551

[22] Filed: Nov. 8, 1990

[30] Foreign Application Priority Data

Nov. 9, 1989 [JP] Japan ..... 1-130906[U]

[51] Int. Cl.[5] ..... G03G 15/00; G03G 15/21

[52] U.S. Cl. ..... 355/200; 355/245; 346/160

[58] Field of Search ..... 355/200, 210, 245; 346/153.1, 160

[56] References Cited

U.S. PATENT DOCUMENTS 4,408,870 10/1983 Nishikawa et al. .
4,470,689 9/1984 Nomura et al. .
4,607,939 8/1986 Saito .
4,873,548 10/1989 Kobayashi et al. ..... 355/200
4,947,208 8/1990 Komatsu et al. ..... 355/200
4,965,640 10/1990 Watarai et al. ..... 355/283

FOREIGN PATENT DOCUMENTS 1352752 4/1971 European Pat. Off. .
0101325 8/1983 European Pat. Off. .
0163486 5/1985 European Pat. Off. .
0272094 12/1987 European Pat. Off. .
2041830 12/1979 United Kingdom .
2168651 6/1986 United Kingdom .

*Primary Examiner*—R. L. Moses

[57] ABSTRACT

An image recording apparatus has a photo sensitive member and records an image in accordance with an electrophotography process. The image recording apparatus includes a housing, an optical system for emitting a light beam used for the electrophotography process, a stopper member provided in the housing at a predetermined position, and an exchanging unit detachably provided in the housing and having a developer device used for the electrophotography process. The exchanging unit also includes an optical element, a supporting mechanism for movably supporting the optical member, and an elastic member for pressing the optical member onto the stopper member when the exchanging unit is loaded in the housing at a predetermined position. The light beam emitted from the optical system passes through the optical member in the exchanging unit and is projected onto the photo sensitive member.

20 Claims, 5 Drawing Sheets

IMAGE RECORDING APPARATUS AND EXCHANGING UNIT USED IN THE SAME

BACKGROUND OF THE INVENTION

The present invention generally relates to an image recording apparatus and an exchanging unit used in the same, and more particularly to an image recording apparatus in which an electrophotography process is performed so that the image is formed, and an exchanging unit which is detachably provided in the image recording apparatus.

A conventional image recording apparatus such as a copy machine and a facsimile, for example, has a photo sensitive medium and records the image in accordance with an electrophotography process. In this type of image recording apparatus, a charger unit, a developer device, a transfer unit, a cleaning device and so on are arranged around the photo sensitive medium. A light beam emitted from a laser unit modulated in accordance with the image data scans a surface of the photo sensitive medium between the charger unit and the developer device. That is, an exposure process is performed by the light beam which scans the photo sensitive medium. An optical system which performs the exposure process has various optical elements such as lenses and mirrors. All of the optical elements are fixed on a base so that a relative position of each optical element is prevented from changing. In addition, it is easy for the optical element close to the developer device to become dirty due to the toner scattered from the developer device. Thus, it is necessary for the optical element close to the developer device to be exchanged or cleaned at a predetermined time.

On the other hand, the image recording apparatus having an exchanging unit which includes the developer device, the charger unit and so on, has been proposed. The exchanging unit having the developer device is exchanged for a new one, for example, when the amount of toner in the developer device is less than a predetermined amount. In another case, the exchanging unit having the photo sensitive medium is exchanged for a new one, for example, when the photo sensitive medium has been used for a predetermined time.

The exchanging unit may be provided with one or a plurality of the optical elements in the optical system for performing the exposure process and it is necessary to exchange this unit at a predetermined time. In this case, when the exchanging unit is exchanged for a new one, the optical elements are also exchanged at the same time. Thus, it is easy for the optical elements to be exchanged at a predetermined time.

However, the exchanging unit must be detachable from the image recording apparatus so that a relative position of the exchanging unit with respect to the image recording apparatus changes slightly. Thus, it is difficult to accurately determine the relative position of each of the optical elements provided in the exchanging unit with respect to the other optical elements in the optical system for performing the exposure process. For example, when an incident position on the optical element (for example, a mirror), at which the light beam for scanning the photo sensitive medium is incident, changes from a regular position, the scanning line is curved, for example, in accordance with a characteristic as shown in FIG. 1. When the scanning line is curved, the quality of the image formed by the image recording apparatus deteriorates.

SUMMARY OF THE INVENTION

Accordingly, a general object of the present invention is to provide an image recording apparatus and an exchanging unit used in the same in which the disadvantages of the aforementioned prior art are eliminated.

A more specific object of the present invention is to provide an image recording apparatus and an exchanging unit used in the same in which it is possible to accurately determine the relative position of an optical element provided in the exchanging unit with respect to an optical system provided in the image recording apparatus.

The above objects of the present invention are achieved by an image recording apparatus having a photo sensitive member, which apparatus records an image in accordance with an electrophotography process. The image recording apparatus comprises a housing, an optical system provided in the housing, for emitting a light beam used for the electrophotography process, a stopper member provided in the housing at a predetermined position, and an exchanging unit detachably provided in the housing and having at least a device used for the electrophotography process. The exchanging unit further comprises an optical member, a supporting mechanism for movably supporting the optical member, and an elastic member for pressing the optical member onto the stopper member when the exchanging unit is loaded in the housing at a predetermined position, wherein the light beam emitted from the optical system passes through the optical member in the exchanging unit and is projected onto the photo sensitive member.

The above objects of the present invention are also achieved by the following exchanging unit, used in the image recording apparatus described above. The exchanging unit is detachably provided in the image recording apparatus. The exchanging unit comprises a device used for the electrophotography process, an optical member, a supporting mechanism for movably supporting the optical member, and an elastic member for pressing the optical member onto the stopper member provided in the image recording apparatus at a predetermined position when the exchanging unit is loaded in the image recording apparatus at a predetermined position, wherein a light beam used for the electrophotography process emitted from an optical system provided in the image recording apparatus passes through the optical member and is projected onto the photo sensitive member.

Additional objects, features and advantages of the present invention will become apparent from the following detailed description when read in conjunction with the accompanying drawings.

DESCRIPTION OF THE PREFERRED EMBODIMENTS

A description will now be given of a preferred embodiment of the present invention with reference to the accompanying drawings.

Figure 2:
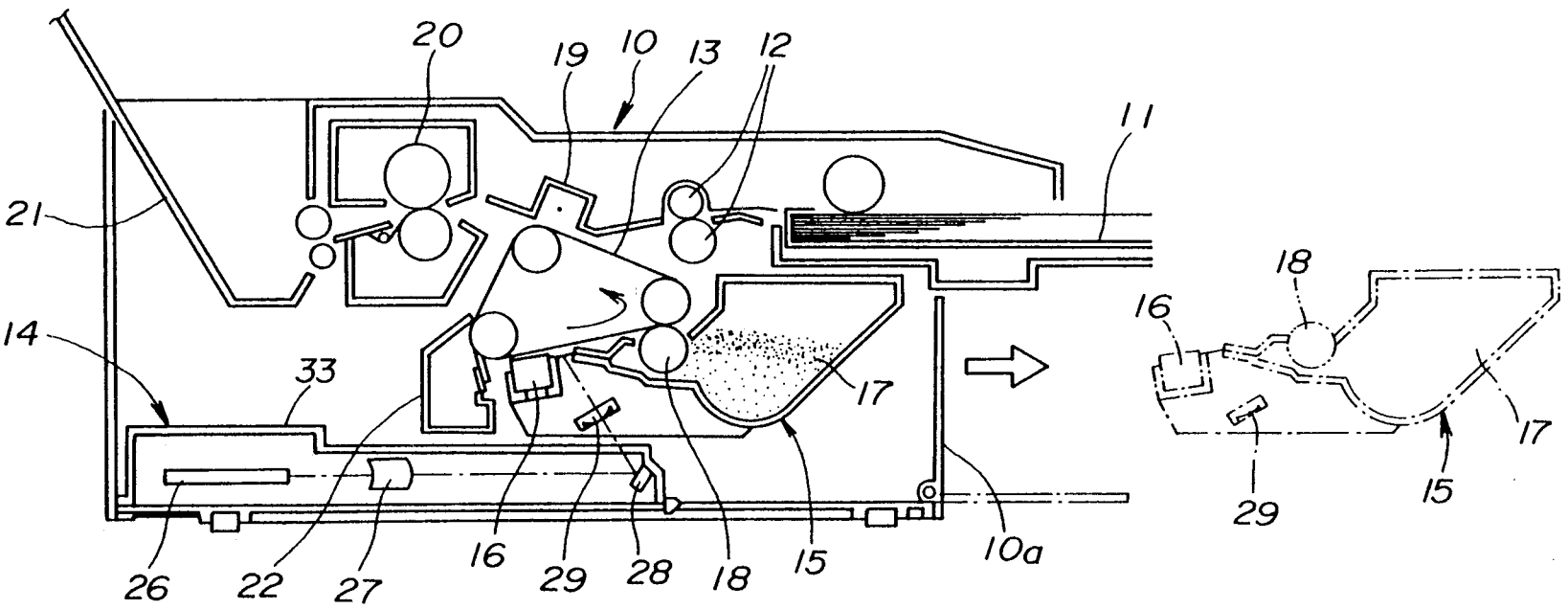
FIG. 2 is a cross sectional view of a copy machine according to an embodiment of the present invention.

Referring to FIG. 2, which shows a structure of a copy machine which is a type of image recording apparatus, the copy machine has a housing 10, a paper supplying tray 11, registration rollers 12, a photo sensitive belt 13, an optical scanning unit 14, an image forming unit 15, a transfer charger 19, a fixer device 20, a tray 21 and a cleaning device 22. The image recording unit 15 has a charger 16 and a developer device including a toner cartridge 17 and a developing roller 18. The photo sensitive belt 13 is rotated in a direction denoted by an arrow in FIG. 2. The charger 16 and the developer device in the image forming unit 15, the transfer charger 19 and the cleaning device 22 are arranged around the photo sensitive belt 13. The image forming unit 15 is a type of exchanging unit, and is detachably provided in the housing 10. The image forming unit 15 is exchanged at a predetermined time. A lid 10*a* provided on a side of the housing 10 is opened an then the image unit 15 is loaded at a predetermined position in the housing 10 or taken out of the housing 10.

Figure 1:
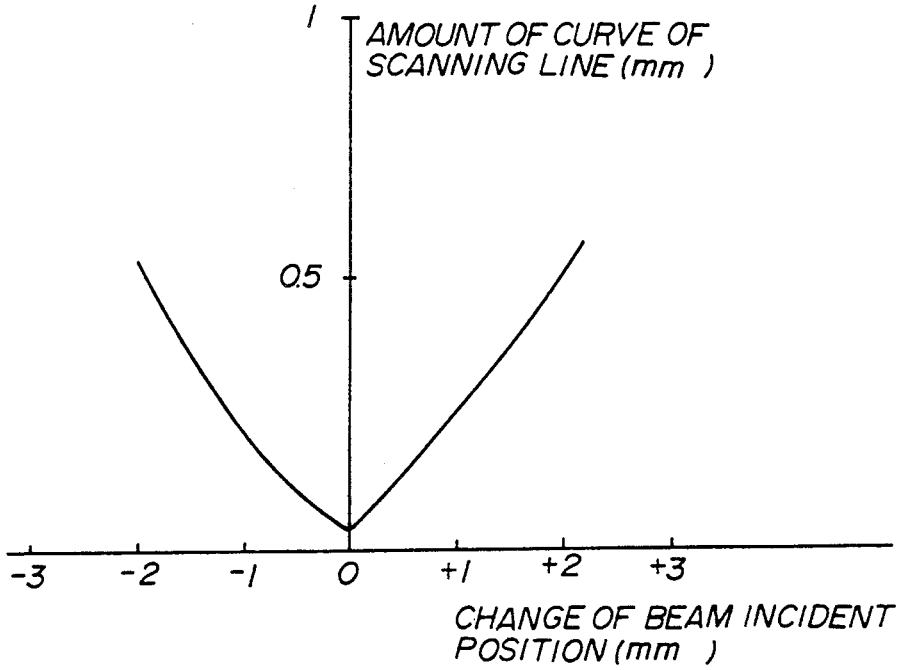
FIG. 1 is a graph showing an example of a relationship between the change of the incident position of the light beam on the optical element and the amount of the curving of the scanning line.
Figure 3:
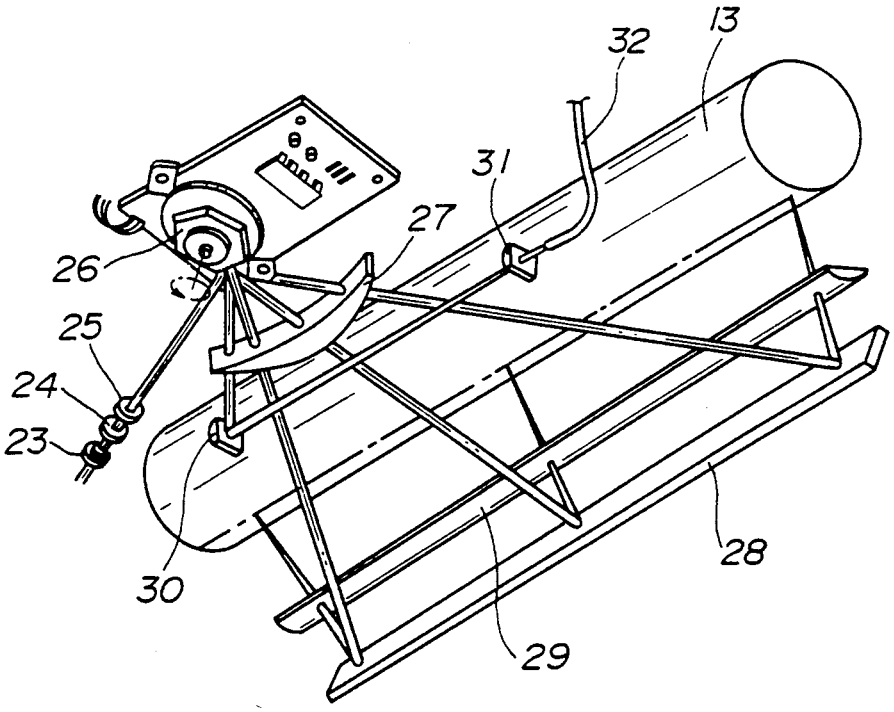
FIG. 3 is a perspective view showing an optical system for scanning a photo sensitive medium.

FIG. 3 shows an optical system for scanning the photo sensitive belt 13. Referring to FIG. 3, a light beam emitted from a laser unit 23 is propagated through a coupling lens 24 and an aperture 25 to a polygonal mirror 26 which is rotated at a predetermined speed. The light beam incident on the polygonal mirror 26 is deflected in accordance with the rotation of the polygonal mirror 26 focused via an f-$\theta$ lens 27, a mirror 28 and a cylindrical lens 29 on the surface of the photo sensitive body 13.

The optical system has a detector for detecting a synchronous light beam. The detector includes a mirror 30, a cylindrical lens 31 and an optical fiber 32.

The laser unit 23, the coupling lens 24, the aperture 25, the polygonal mirror 26, the f-$\theta$ lens 27 and the mirror 28 from among the optical elements in the optical system are housed in a housing 33. These optical elements housed in the housing 33 are fixed on a base in the housing 33. The cylindrical lens 29 in the optical system is provided in the image forming unit 15.

Figure 4:
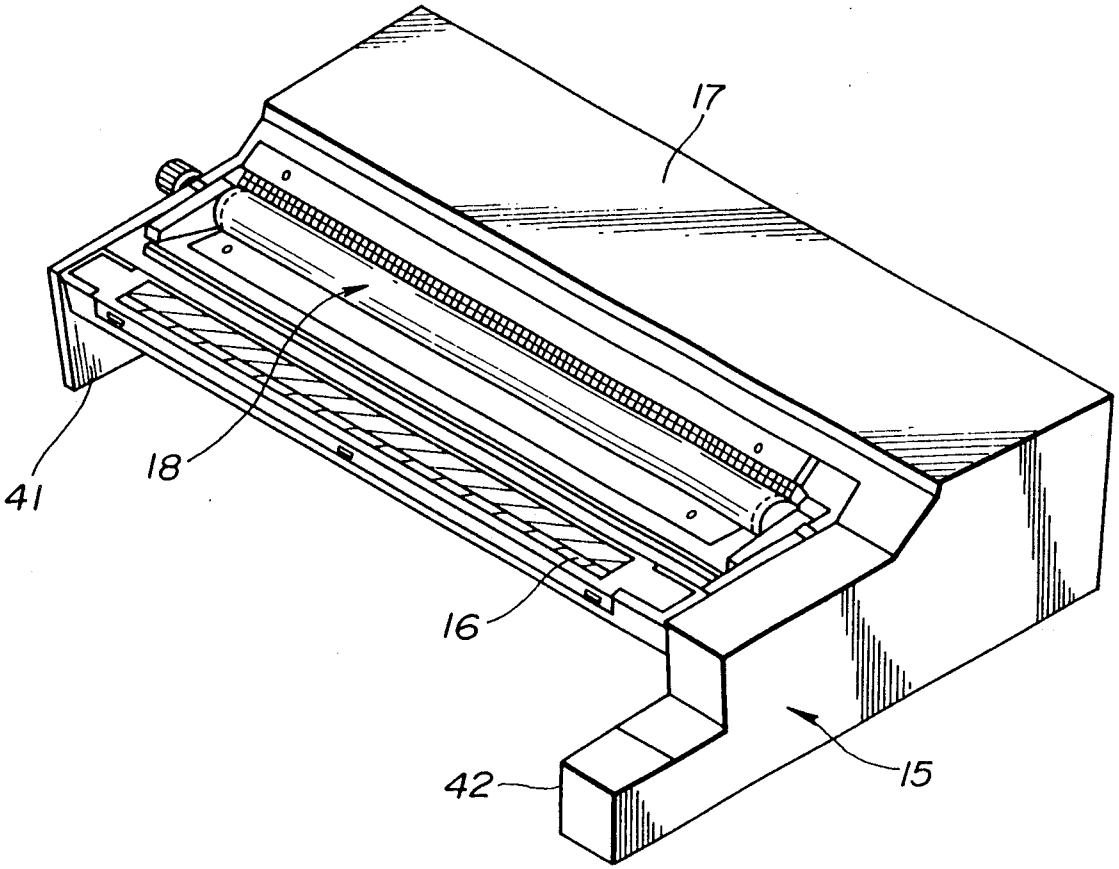
FIG. 4 is a perspective view showing an exchanging unit according to an embodiment of the present invention.
Figure 5:
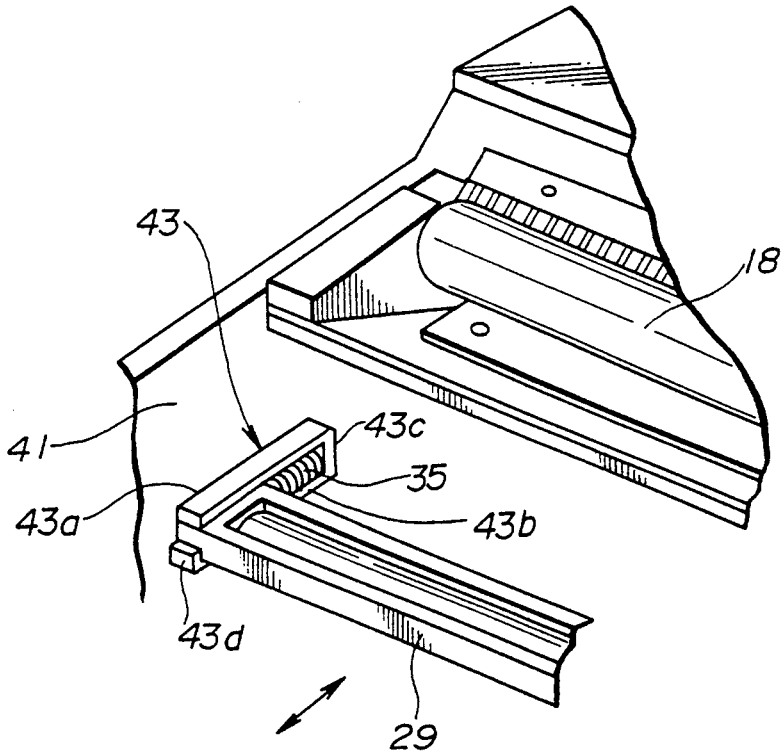
FIG. 5 is a perspective view in section in which a detailed structure of the exchanging unit is shown.

The image forming unit 15 is formed as shown in FIG. 4. That is, the charger 16 and the developer device including the toner cartridge 17 and the developing roller 18 are put between side walls 41 and 42, and the charger 16, the developer device and the side walls 41 and 42 are integrated. A supporting member 43 is provided on an inside surface of the side wall 41 and integrated with the same. The supporting member 43 has a upper plate 43*a*, a lower plate 43*b* and an end plate 43*c*. The upper plate 43*a* and the lower plate 43*b* are separated from each other by a predetermined distance. The end plate 43*c* connects an end of the upper plate 43*a* and an end of the lower plate 43*b*. Thus, the upper plate 43*a*, lower plate 43*b* and end plate 43*c* form a three-sided frame. A side end of the cylindrical lens 29 is put between the upper plate 43*a* and lower plate 43*b* of the supporting member 43 so that the cylindrical lens 29 is capable of sliding between the upper plate 43*a* and lower plate 43*b*. That is, the cylindrical lens 29 is slidably supported by the supporting member 43. A stopper 43*d* is provided at another end of the lower plate 43*b* and the stopper 43*d* prevents the cylindrical lens 29 from coming out of the frame formed of the upper plate 43*a*, the lower plate 43*b* and the end plate 43*c*. A coil spring 35 is provided between the end plate 43*c* and an end surface of the cylindrical lens 29. The cylindrical lens 29 is pressed on the stopper 43*d* by a predetermined resiliency of the coil spring 35. Another supporting member is provided on an inside surface of the side wall 42, and another side end of the cylindrical lens 29 is slidably supported by this supporting member in the same manner as in the case shown in FIG. 5.

Figure 6:
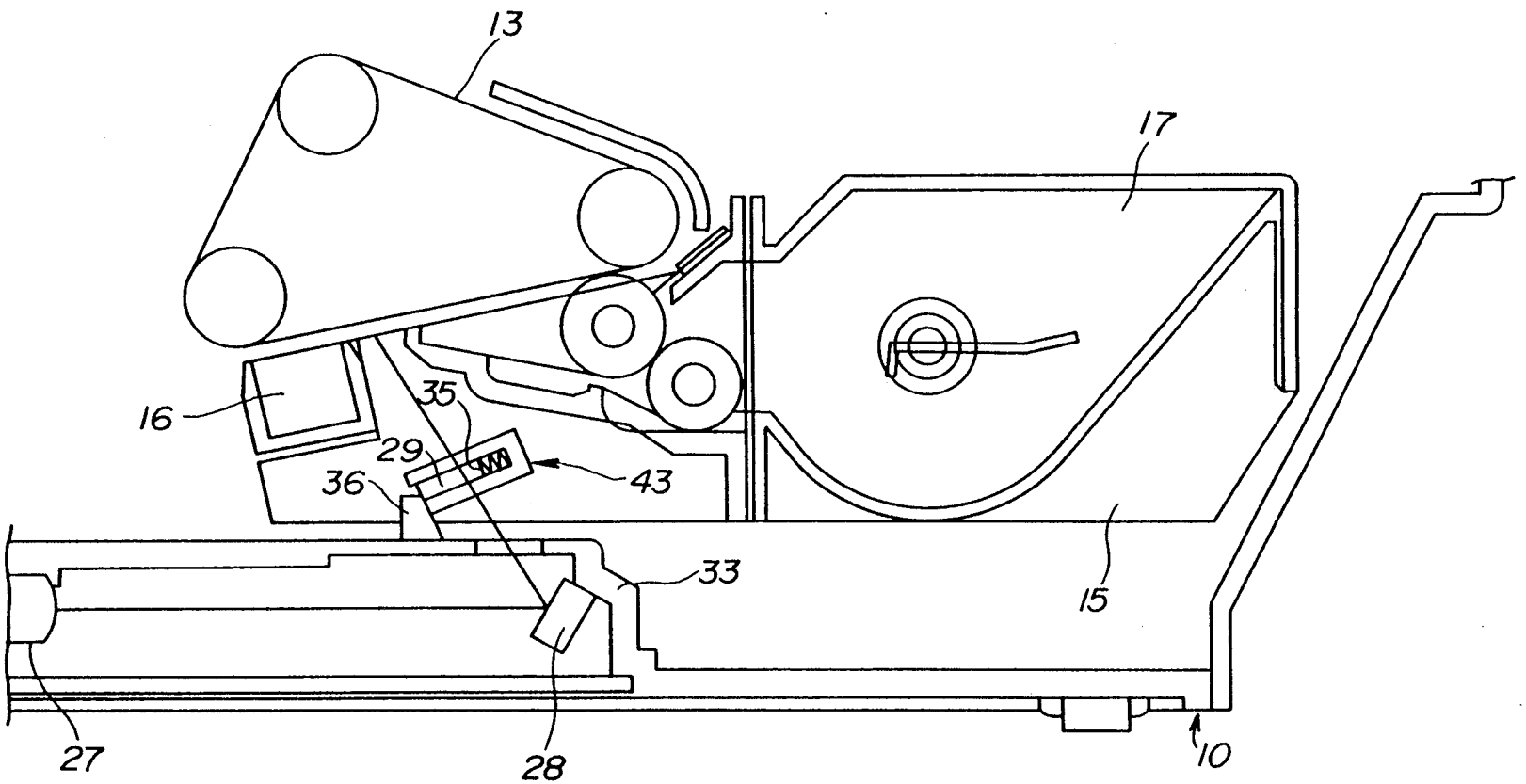
FIG. 6 is an enlarged sectional view showing an exchanging unit fixed in the copy machine.

A stopper member 36 projects from a top surface of the housing 33 for housing the optical elements, as shown in FIG. 6. When the image forming unit 15 is loaded at a predetermined position in the housing 10, the cylindrical lens 29 is brought into contact with the stopper 36 and pushed by the stopper member 36 so that the cylindrical lens 26 moves in a direction in which the coil spring 35 is compressed. Thus, the cylindrical lens 29 is tightly pressed on the stopper member 36 by the resiliency of the spring coil 35. The cylindrical lens 29 is capable of sliding in a direction perpendicular to an axis of the light beam 34, as denoted by an arrow shown in FIG. 7. Therefore, even if the position at which the image forming unit 15 is loaded is slightly changed, the state in which the cylindrical lens 29 is tightly pressed against a sloping surface 36*a* of the stopper member 36 is maintained. That is, even if the position at which the image forming unit 15 is located is slightly changed, the position at which the light beam is incident on the cylindrical lens 29 is not changed.

Figure 7:
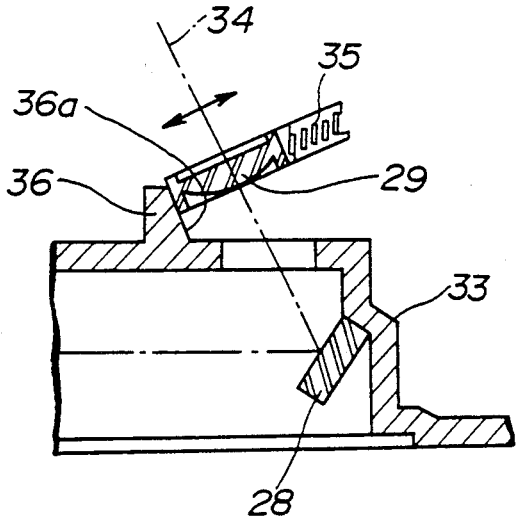
FIG. 7 is a sectional view showing a state where a lens provided in the exchanging unit is engaged with an optical scanning unit.

When the image forming unit 15 is loaded in the housing 10 the distance between the photo sensitive belt 13 and the cylindrical lens 29 is, for example, approximately 25 mm. The light beam emitted from the optical system in the housing 33 is projected via the cylindrical lens 29 onto the surface of the photo sensitive belt 13. Thus, the light beam passing through the cylindrical lens 29 scans the surface of the photo sensitive belt 13. That is, the exposure process is performed The position at which the cylindrical lens 29 is provided, an inclination of the cylindrical lens 29, the position at which the stopper member 36 is provided and the inclination of the sloping surface 36*a* of the stopper member 36 are respectively determined so that the light beam from the optical system in the housing 33 is incident on the cylindrical lens 29 in a direction perpendicular to the cylindrical lens 29, as shown in FIG. 7. In this case, the surface of the cylindrical lens 29 is perpendicular to the sloping surface 36*a* of the stopper member 36.

The exchanging unit is not limited to the image forming unit including the charger and the developer device. For example, it is possible to detachably provide another unit such as a unit including the photo sensitive body in the image recording apparatus.

According to the present invention, it is possible to determine the relative position of the optical element provided in the exchanging unit with respect to the optical system provided in the image recording apparatus.

The present invention is not limited to the aforementioned embodiments, and variations and modifications may be made without departing from the scope of the claimed invention.

What is claimed is:

1. An image recording apparatus having a photo sensitive member, which apparatus records an image in accordance with an electrophotography process, said image recording apparatus comprising:

a housing;

an optical system provided in said housing, for emitting a light beam used for the electrophotography process;

a stopper member provided in said housing at a predetermined position; and an exchanging unit detachably provided in said housing and having at least a device used for the electrophotography process, said exchanging unit further comprising, an optical member, a supporting mechanism for movably supporting said optical member, and an elastic member for pressing said optical member onto said stopper member when said exchanging unit is loaded in said housing at a predetermined position, wherein the light beam emitted from said optical system passes through said optical member in said exchanging unit and is projected onto said photo sensitive member.

2. An image recording apparatus as claimed in claim 1, wherein said supporting mechanism has a first supporting member for movably supporting an end of said optical member and a second supporting member for movably supporting another end of said optical member.

3. An image recording apparatus as claimed in claim 2, wherein said exchanging unit further comprises a first side wall and a second side wall, said device used for the electrophotography process being put between said first side wall and said second side wall, and wherein said first supporting member is integrated with an inside surface of said first side wall and said second supporting member is integrated with an inside surface of said second side wall.

4. An image recording apparatus as claimed in claim 2, wherein said elastic member has a first elastic element for pressing an end portion of said optical member and a second elastic element for pressing another end portion of said optical member.

5. An image recording apparatus as claimed in claim 1, wherein said optical member is inclined at a predetermined angle and said stopper member has a surface in contact with said optical member, said surface of said stopper member being inclined so that a surface of said optical member is perpendicular to said surface of said stopper.

6. An image recording apparatus as claimed in claim 2, wherein each of said first supporting member and said second supporting member have an upper plate, a lower plate, an end plate connecting an end of said upper plate and an end of said lower plate and a stopper plate provided at another end of at least either the upper plate or lower plate, said upper plate and said lower plate being separated from each other by a predetermined distance, and wherein the end of said optical member is provided between said upper plate and said lower plate.

7. An image recording apparatus as claimed in claim 6, wherein said elastic member has a spring provided between said end plate and said optical member.

8. An image recording apparatus as claimed in claim 1, further comprising an optical system housing, said optical system being housed in said optical system housing, wherein said exchanging unit is loaded at a position over said optical system housing and said stopper member has a projection member which projects from said optical system housing toward said exchanging unit.

9. An image recording apparatus as claimed in claim 1, wherein said device used for the electrophotography process includes a developer device.

10. An image recording apparatus as claimed in claim 1, wherein said elastic member has a spring.

11. An image recording apparatus as claimed in claim 1, wherein said optical member has a cylindrical lens.

12. An exchanging unit detachably provided in an image recording apparatus which has a photo sensitive member and records an image in accordance with an electrophotography process, said exchanging unit comprising:

a device used for the electrophotography process;

an optical member;

a supporting mechanism for movably supporting said optical member, and an elastic member for pressing said optical member onto a stopper member provided in said image recording apparatus at a predetermined position when said exchanging unit is loaded in said image recording apparatus at a predetermined position, wherein a light beam used for the electrophotography process and emitted from an optical system provided in said image recording apparatus passes through said optical member and is projected onto said photo sensitive member.

13. An exchanging unit as claimed in claim 12, wherein said supporting mechanism has a first supporting member for movably supporting an end of said optical member and a second supporting member for movably supporting another end of said optical member.

14. An exchanging unit as claimed in claim 13, further comprising a first side wall and a second side wall, said device used for the electrophotography process being put between said first side wall and said second side wall, and wherein said first supporting member is integrated with an inside surface of said first side wall and said second supporting member is integrated with an inside surface of said second side wall.

15. An exchanging unit as claimed in claim 13, wherein said elastic member has a first elastic element for pressing an end portion of said optical member and a second elastic element for pressing another end portion of said optical member.

16. An exchanging unit as claimed in claim 13, wherein each of said first supporting member and said second supporting member have an upper plate, a lower plate, an end plate connecting an end of said upper plate and an end of said lower plate and a stopper plate provided at another end of at least either the upper plate or lower plate, said upper plate and said lower plate being separated from each other by a predetermined distance, and wherein the end of said optical member is provided between said upper plate and said lower plate.

17. An exchanging unit as claimed in claim 16, wherein said elastic member has a spring provided between said end plate and said optical member.

18. An exchanging unit as claimed in claim 12, wherein said device used for the electrophotography process includes a developer device.

19. An exchanging unit as claimed in claim 12, wherein said elastic member has a spring.

20. An exchanging unit as claimed in claim 12, wherein said optical member has a cylindrical lens.

* * * * *